US005806649A

United States Patent [19]

Walsh et al.

[11] Patent Number: 5,806,649

[45] Date of Patent: Sep. 15, 1998

[54] PAPER CURRENCY VALIDATOR

[75] Inventors: Michael Walsh, East Patchoque; Miroslaw Blaszczec, Lindenhurst, both of N.Y.

[73] Assignee: Coin Bill Validator, Inc., Hauppauge, N.Y.

[21] Appl. No.: 751,249

[22] Filed: Nov. 18, 1996

Related U.S. Application Data

[63] Continuation of Ser. No. 260,120, Jun. 15, 1994, abandoned.

[51] Int. Cl.[6] ..... G07D 7/00

[52] U.S. Cl. ..... 194/203; 194/207; 250/556

[58] Field of Search ..... 194/206, 207, 194/203; 209/534; 356/71; 250/556; 271/262, 263, 265.04

[56] References Cited

U.S. PATENT DOCUMENTS

| | | | |
|---|---|---|---|
| 3,159,277 | 12/1964 | Carlson et al. | 194/207 X |
| 4,513,439 | 4/1985 | Gorgone et al. | 356/71 X |
| 4,588,292 | 5/1986 | Collins | 356/71 |
| 4,881,268 | 11/1989 | Uchida et al. | 250/556 X |
| 4,884,671 | 12/1989 | Gardellini | 194/207 |
| 5,005,688 | 4/1991 | Yukimoto et al. | 194/206 |
| 5,150,174 | 9/1992 | Ryczek et al. | 356/402 |
| 5,195,739 | 3/1993 | Watabe | 194/206 |
| 5,242,041 | 9/1993 | Isobe | 194/207 |
| 5,303,037 | 4/1994 | Taranowski | 356/406 |
| 5,304,813 | 4/1994 | De Man | 250/556 |

FOREIGN PATENT DOCUMENTS

| | | | |
|---|---|---|---|
| 56-161244 | 12/1981 | Japan | 271/263 |
| 91/03031 | 3/1991 | WIPO | 194/207 |

*Primary Examiner*—F. J. Bartuska
*Attorney, Agent, or Firm*—Bauer & Schaffer

[57] ABSTRACT

Individual sheets of paper currency or bills are conveyed in line in a path from a receiving inlet slot through a verification station and outputting verified currency through a storage slot. The verification station senses the value and authenticity of the currency and converts the value into a signal and thereafter moves the paper currency to the storage station where they are securely stacked one on top of the other.

5 Claims, 4 Drawing Sheets

PAPER CURRENCY VALIDATOR

This is a Continuation of Ser. No. 08/260,120, filed Jun. 15, 1994, now abandoned.

FIELD OF THE INVENTION

The present invention relates to a mechanism for insuring the security of a currency validator in which the validity and value of paper currency is determined.

BACKGROUND OF THE INVENTION

In accordance with the dramatic increase in the price of products and services, paper currency exchangers have become widely used in connection with the operation of various vending machines, automated games and money dispensing machines. In the past, such currency validators were employed to merely provide the user with a number of coins corresponding to the value of the paper currency input. More recently, it has become desirable to provide such machines as an integral component of the vending machine, or the like, in which the paper currency is inserted as an alternative to the conventional use of coins.

For example, U.S. Pat. No. 4,348,656 to Gorgone et al. discloses a digital validator which takes a multiplicity of data samples from inserted currency and converts the samples into a digital code. The data samples are then utilized for solving complex transforms, the results of which are compared against results obtained from known valid securities to determine the authenticity of the paper offered.

U.S. Pat. No. 4,884,671 to Gardellini discloses a similar currency validator for use as a retrofit for a coin vending machine or the like. The validator includes longitudinally directed coextensive verification and receiving stations through which successive sheets of paper currency are moved with their planar surfaces substantially vertical from an inlet to a storage position wherein the sheets are stacked in their vertical positions thereby enabling the validator to be mounted horizontally in the limited space of the machine for cooperation with the machine's coin mechanism.

Even with the prior art validators of the type set forth above, clever thieves have still found ways of subverting the known security measures and substantial losses have not been adequately prevented.

With this increased use of such money machines, problems in security and maintenance have arisen which have, of course, received a great deal of attention and many attempts at solution.

The most common problem is guarding against the receipt of and payout against counterfeit or simulated currency. Various sophisticated techniques have been devised by unscrupulous individuals by which the security provisions of known currency machines have been defeated. One such technique is known as "stringing." In this situation, a string or wire is attached to the note when it is deposited in the machine and the note is then retrieved via the string or wire after the machine has determined the note to be authentic and has appropriately credited the depositor with change or goods.

Another problem plaguing currency validators is that caused by current photocopying techniques. Using a photocopier, a sheet of paper currency may be accurately reproduced and used to defeat known currency validators. For example, after some experimentation with conventional high resolution color photocopying, an individual may reproduce a copy of paper currency having reflective and transmissive properties similar to that of the original currency. The use of magnetic photocopy toner yields a reproduction having similar magnetic properties. Thus, using relatively simple and well known techniques, known currency validators are easily defeated into receiving and validating counterfeit currency that visual inspection would otherwise prevent.

Accordingly, there exists a need for a currency validator that provides advanced security functions heretofore unavailable.

It is an object of the present invention to provide a currency validator which prevents the stringing of paper currency in order to defeat the apparatus.

Another object of the invention is to provide a paper currency validator which is relatively simple in construction and inexpensive to manufacture and which may be used as an original part or as a retrofit device coin-only operated machines.

Yet another object of the present invention is to provide a paper currency validator which is less susceptible to defeat by the insertion of counterfeit bills, mosaics, and other facsimiles.

These objects, as well as other objects and advantages, will be apparent from the following disclosure of the present invention.

SUMMARY OF THE INVENTION

According to the present invention, a currency validator is provided comprising means for conveying individual sheets of paper currency or bills in-line in a path from a receiving inlet slot through a verification station and outputting the verified currency to a storage means. The verification station includes means for determining the validity of the currency and sensing the value of the currency and, upon the determination that the currency is valid, converting the value into a signal indicative of its value and so signalling the vending mechanism to provide change, goods or services therefor and, upon the determination of invalidity, to reject and return the paper currency to the customer.

The means for sensing includes spectral analysis means, operative on and responsive to spectral emissions from the paper of the currency and substantially transparent to the ink thereon. In particular, the spectral analysis is obtained employing a blue light diode and photosensor sensitive to the blue light only in addition to conventional infrared and magnetic detection. The advantage found employing the blue light is that it does not read the ink on the currency, but reads the content of the paper being used in the currency. Thus, security against the deposit of counterfeit, photocopied currency is obtained.

In further construction of the invention, the present invention provides apparatus by which valid currency cannot be retrieved by an unlawful user once it has been determined to be valid and invalid currency, such as partial bills, bills with tails, and the like will not be evaluated and will be summarily rejected. Another aspect of the present invention is to ensure that all valid currency inserted into the machine is kept and that the technique of "stringing" is aborted and prevented.

RELATED DISCLOSURE

The present currency validator employs certain details found in U.S. Pat. Nos. 4,884,671 and 5,259,490 issued to Ivo Gardellini, to which reference to such details and the disclosure of said patents are to be made as if more fully set forth herein.

The present invention is used also with the inventions disclosed in U.S. patent applications Ser. No. 08/260,061, entitled ELECTRICAL SWITCH CONNECTORS (Attorney's Docket No. P-2824-7) and Ser. No. 08/260,062 now U.S. Pat. No. 5,527,031 entitled MECHANISM FOR INSURING ALIGNMENT OF CURRENCY IN CURRENCY VALIDATORS (Attorney's Docket No. P-2824-8), filed simultaneously herewith, by the same inventors. The disclosures of these applications are incorporated herein as if more fully set forth.

Full details of the invention are set forth in the following disclosure, and illustrated in the accompanying drawings.

DESCRIPTION OF THE INVENTION

Figure 1:
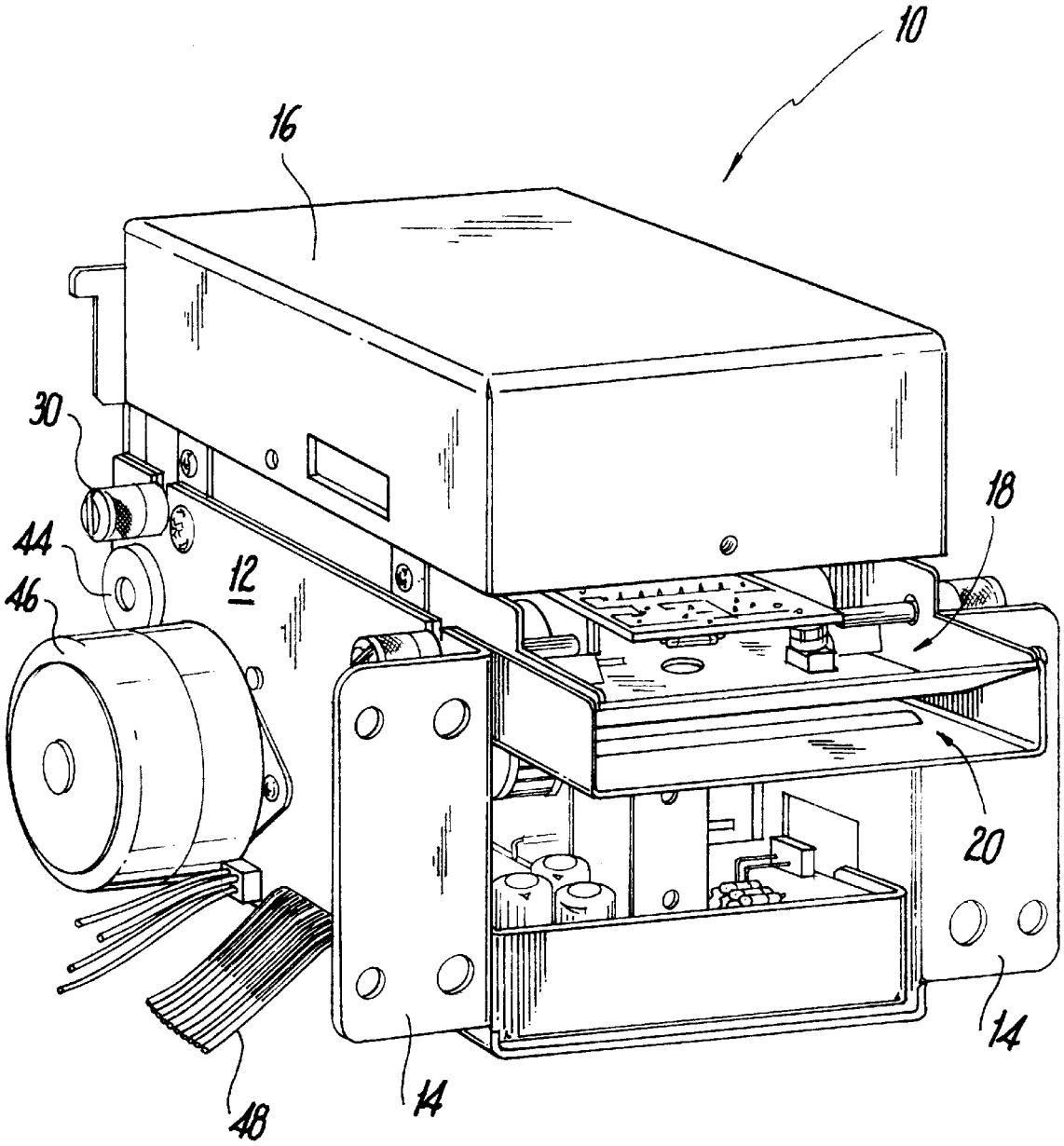
FIG. 1 is a perspective view of the currency validator of the present invention.

As will be seen from specific reference to FIG. 1, the paper currency validator of the present invention is generally denoted by reference numeral 10. The paper currency validator 10 is capable of mounting on a face or door of a vending machine or on another support and is therefore provided with a housing 12 having mounting brackets 14 and a cover 16.

Figure 2:
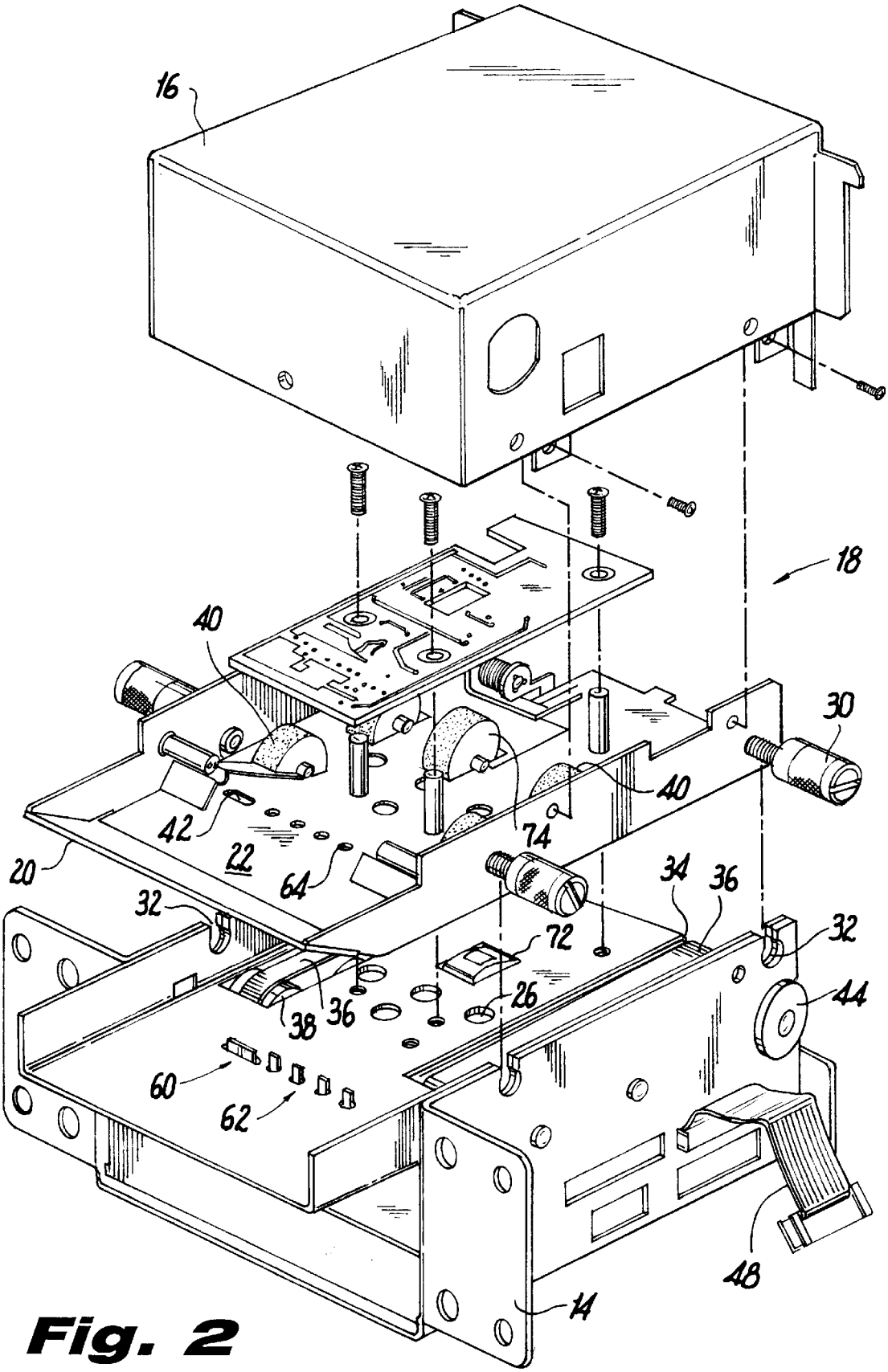
FIG. 2 is a partially exploded top perspective view of the currency validator of the present invention taken from the opposite angle as that of the perspective view of FIG. 1 and illustrating the currency passageway.
Figure 3:
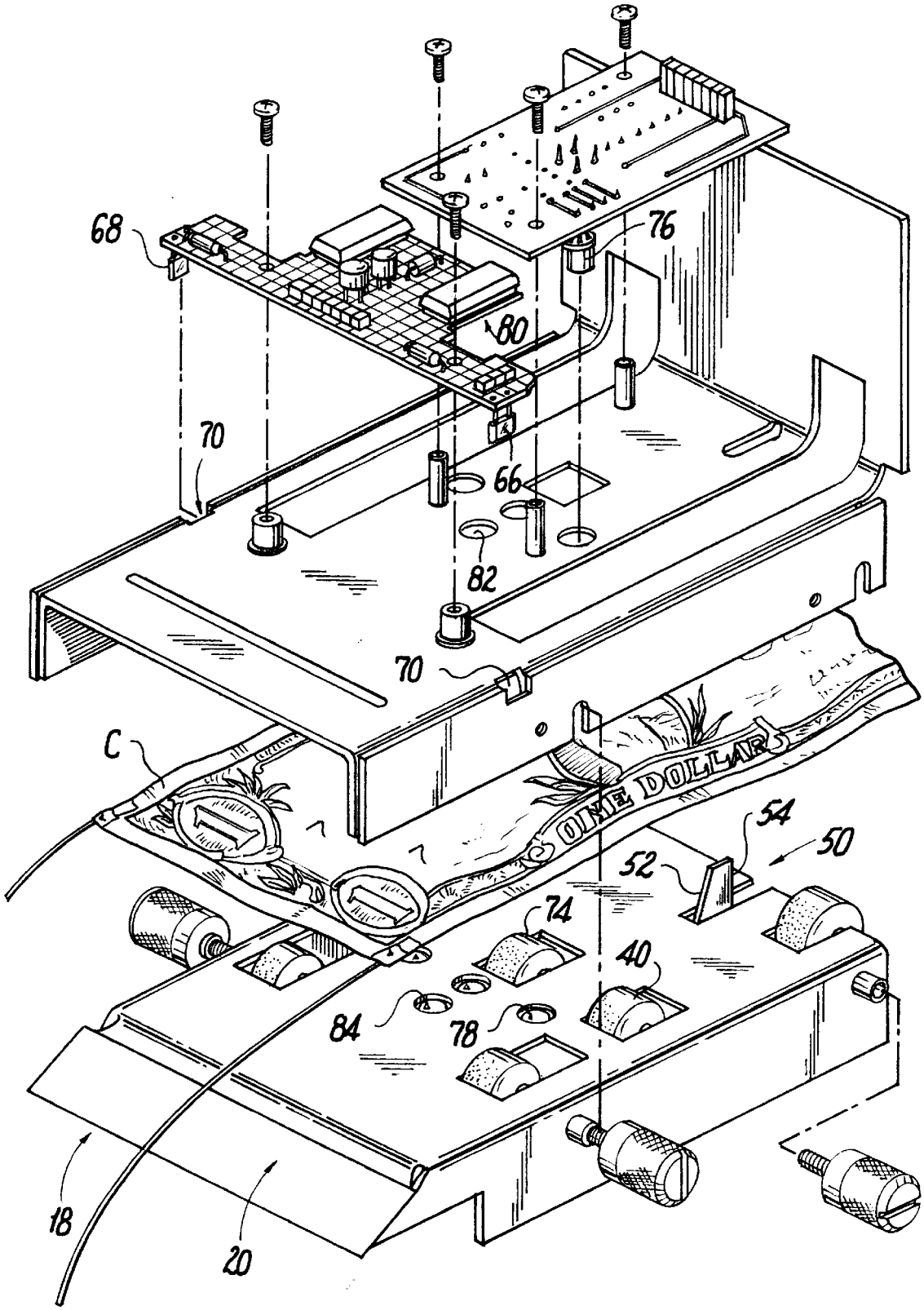
FIG. 3 is a view similar to that of FIG. 2 taken from below the currency validator and showing the movement of money through the passageway.

Located within the housing 12 is the verification station shown generally by the numeral 18. The verification station includes an inlet slot 20 into which paper currency, i.e., a single bill, is received and a passageway for the paper currency C which, as seen in FIGS. 2 and 3, is defined by a pair of trough-shaped plates, identified by reference numerals 22 and 24. The plates 22 and 24 are telescoped together with the upper member 22 received within the bottom member 24 in top to bottom engagement. The bottom outer trough 24 is of generally U-shaped cross-section, having a pair of side walls extending perpendicular to its bottom wall which are fixed by set screws to the sidewalls of the housing. The top inner trough 22 is also of U-shaped cross-section and has sidewalls perpendicular to a bottom wall. As illustrated, the inner and outer troughs 22, 24 are open at their upstream inlet slot 20 and downstream exit ends 28. Although the inlet end of the top wall of inner trough 22 is smoothly curved upward so that when assembled with the bottom trough, it angles away from the bottom wall of the outer trough 24 to define the funnel-like inlet slot, generally identified earlier by the reference numeral 20. Located inward a small distance from the mouth of the inlet slot 20 is a detector 21 for sensing the leading edge of the inserted currency. The detector 21 may be a microswitch or it may be a photodetector pair.

In order to provide secure alignment as well as access to the passageway for cleaning, servicing or other maintenance, the inner and outer troughs 22, 24 are dimensioned so as to provide a slight frictional engagement between their side walls. Thumbwheel screws 30 are threaded into the sidewalls of the inner trough 22 which fit into aligned cut-outs 32 formed in the housing 12 and also in the side walls of the lower trough 24.

The cut-outs 32 provide a limit stop for the relative telescoping engagement of the troughs 22 and 24. This stop ensures the proper formation and retention of the passageway by defining a narrow, continuous flat space extending the length of the troughs through which paper currency may freely move and be guided and enable the swift and easy disassembly of the two troughs.

The bottom wall of the bottom outer trough 24 is formed with elongated longitudinally extending rectangular cut-outs 34 laterally spaced by a distance roughly equal to the width of the paper currency. Located within the housing 12 beneath the bottom trough 24 are a pair of high-friction endless conveyor belts 36 the upper runs of which extend respectively into the elongated cut-outs 34 and thus into the currency passageway to engage and move the paper currency C from inlet 20 through the verification station 18. The belts are respectively entrained over a set of longitudinally spaced belt rollers 38 which are fixed on common shafts respectively journalled in the side walls of the housing 12, one set of rollers being driven by a motor.

The bottom wall of the top inner trough 22 is provided with small rectangular cut-outs vertically aligned with the longitudinal cut-outs in the bottom outer trough 24. Mounted within the small cut-outs are idler rollers 40. As seen in FIG. 2, the idler rollers 40 are mounted on shafts borne in bent, spring-like extensions 42 compressed beneath a fixed horizontal pin which cooperatively act to bias the rollers 40 against the endless conveyor belts 36 when the troughs 22 and 24 are assembled. In this manner, currency will be firmly engaged and gripped between the idler rollers 40 and conveyor belts 36 so that it is securely transported and moved upstream or downstream.

The shaft of the upstream set of belt rollers 38 is driven via conventional transmission 44 by a conventional reversible stepper motor 46 fixedly mounted on the exterior housing 12. By using a stepper motor 46, the currency may be transported in increments, or steps of a predetermined intervals and for predetermined distances. The stepper motor 46 is capable of driving the conveyor belts 36 in both the upstream and downstream directions dependent upon the polarity of the current provided to it. The stepper motor (omitted for clarify from FIG. 2) is connected to a suitable control system via cable 48.

The currency validator of the present invention is provided with several mechanical safety features insuring that properly sized bills are evaluated and that once evaluated, the bills remain in the system and may not be returned or removed.

Figure 4:
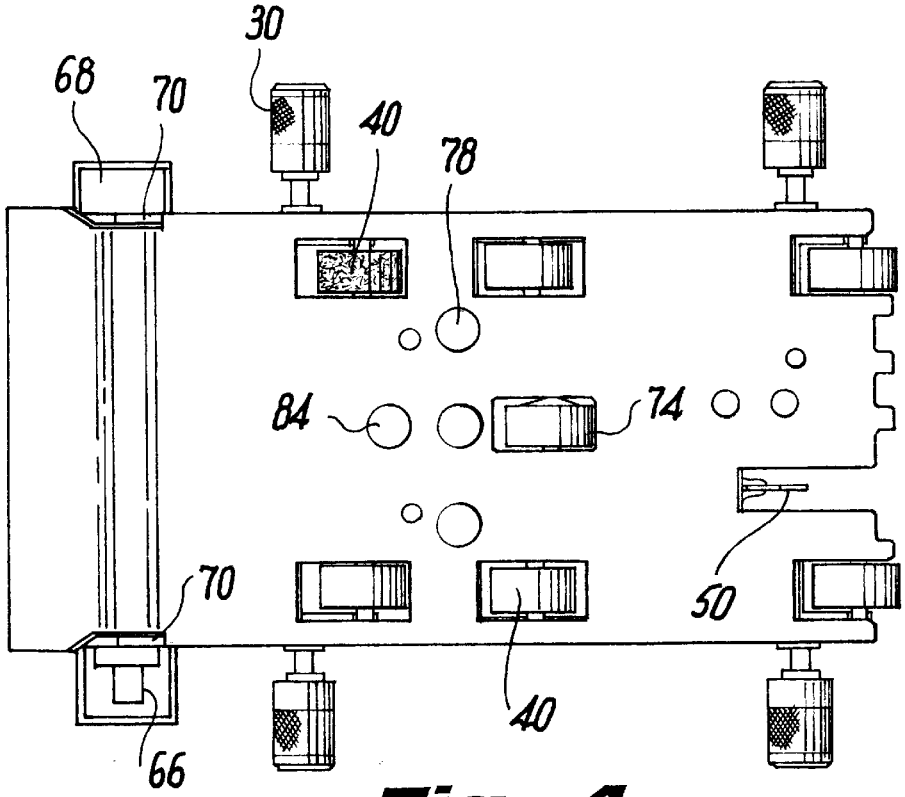
FIG. 4 is a bottom plan view of the lower outer trough illustrating the currency path P.
Figure 5:
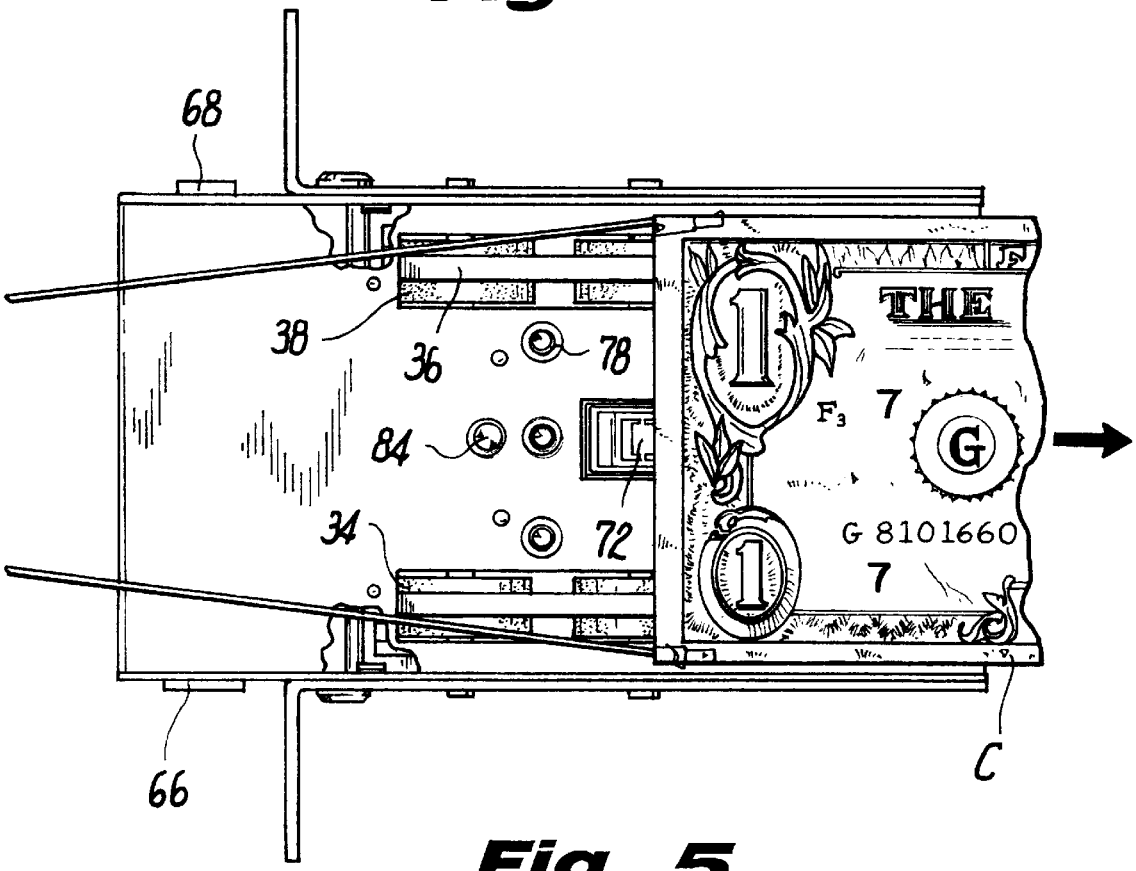
FIG. 5 is a partial top view of the currency validator of the present invention illustrating the prevention of "stringing".

Also provided is an anti-stringing mechanism for preventing the currency C from being drawn back through the currency passageway once it has been consigned to storage. First, a tactile sensor, shown in FIGS. 3 and 4 is provided proximate the downstream end of the currency passageway. This sensor provides a downstream gate 50 formed of a sheet of lightweight aluminum arranged in a plane parallel to the direction of the movement of the currency. The downstream gate 50 is mounted upon a spring and projects from a slot formed in the bottom of the top trough 22 and has a smooth acute angle 52 on its rear edge and a vertical forward edge 54 on its opposite edge. In operation, the currency C is moved downstream through the currency passageway and upon coming into contact with the downstream gate 50, forces the gate 50 out of the currency passageway allowing the bill to move into the storage area. When the currency C has completely moved past the downstream gate 50, the spring forces the gate 50 back through the slot and hence, back into the currency passageway thus making it impossible for the bill C, which has been validated and which is intended to be passed to storage, from being pulled back to the inlet.

Secondly, the currency validator 10 is provided, as seen in FIG. 2, with an upstream gate 60 arranged just inside the passageway from the inlet 18 and at a distance from the rear gate 50 slightly longer than the length of the bill, or currency being evaluated, from the rear gate 50. (FIG. 3 omits the gate 60 for clarity.) The upstream gate 60 is kept in a normally open position mounted below the lower trough 24. Once the currency C has been determined to be valid, the upstream gate 60 is closed and remains closed until credit has been issued by the validator 10 and the currency has been passed through to storage. As illustrated, the upstream gate 60 comprises a laterally extending member having a series of teeth 62 extending vertically therefrom. In a closed state, the teeth extend through via holes 64 provided in the top and bottom troughs 22, 24. Should the currency C be longer than a valid bill, or should a "tail" or extension be attached to the currency (as seen in FIG. 7), then the upstream gate will be prevented from closing and the motor operated to exercise a reject of the bill.

Another form of stringing has been noticed in the field use of currency validators. Unscrupulous users have begun to put "tails" on valid currency, as for example, adhering lengths of transparent tape to the rear edge of the bill. Such tape, being sufficiently strong and well adhered to the bill permits the user, with a minimum of shill, to jerk and yank the bill backwards once the bill has been evaluated and the exchange of money or goods effected. The transparency of the tape "tail" avoids sensing by the validating detectors. Similarly, "tails" may be placed on partial bills which contain just enough indicia to pass inspection at the evaluating sensors.

To overcome the problem of "tailing", a photosensing pair is arranged just inside the inlet and prior to the position indicated by the upstream gate. The photosensing pair comprises a light emitting diode 66 and a photodetector 68 straddling the sidewall of the outer, lower trough 24 which sidewalls are provided with window-like openings 70 transversely aligned to the passageway P between the bottom wall of the upper, inner trough 22 and the bottom of the outer trough 24. The diode 66 and detector 68 are placed opposite each other so that the light passes transversely through the passageway. Thus, should this light be interdicted by any means, such as a "tail", even when a properly sized bill is or seems to be properly positioned beneath the evaluation sensors or units in the evaluation section, sensing will be stopped and the bill rejected. No matter how thin or transparent the "tail" is made, the narrow height of the passageway is such that the "tail" will be sensed. Should "strings" be used, the fluttering of the string as it moves into the evaluating section will also be detected.

The determination of the currency validity and value is determined through the use of several detector mechanisms. Mounted to extend through a central cut-out in the bottom wall of the bottom trough 24 is a magnetic sensing assembly including a magnetic head 72 which senses critical indicia found in the paper currency C. It is known, for example, that currency, particularly U.S. currency, contains magnetic indicia in its body indicating its value and its authenticity. Sensing means for detecting the magnetic indicia to verify the authenticity of the paper money are well known, as reference to the earlier mentioned patents will show. In order to provide a proper interface between the currency C as it is transported in the passageway and the magnetic head 72, an idler roller 74 is provided in a cut-out in the top trough 22, vertically aligned with the magnetic head 72. The idler roller 74 compressively engages against the magnetic head such that the currency C is kept in constant contact with the magnetic head while being transported through the currency passageway. In this manner, variations in the distance between the currency C and the magnetic head are avoided as is the concomitant inaccuracy which might be caused therewith.

In addition to the magnetic sensing assembly, the validator 10 includes three infrared sensing detectors comprising diodes 76 provided in the bottom trough 24 and vertically aligned infrared detectors 78 mounted in the top of trough 22. Infrared detectors are similarly known in the prior art and effectively read the face of currency being responsive to the variations of the print. With the advent of improved photocopying techniques and graphic art techniques, it has been found that infrared detectors can be easily fooled.

After much effort, it has been found that blue light detectors are extremely effective in determining the validity of the paper, i.e., its "rag" and cellulose content as well as impurities and other contents within the paper itself.

Accordingly, to the present invention, a spectral detector 80 for the paper is provided. The spectral detector 80 comprises a blue light emitting diode 82 mounted in the lower trough 24. The blue diode 82 is characterized in that it emits light having a wavelength of 470 nm which, when currency is exposed to such light, the details of the paper itself are highlighted due, in part, to the chemical composition of the paper. This makes it particularly advantageous for use in currency evaluation systems providing a similar effect utilized in visual and manual handling of the systems. Mounted in a vertically aligned manner above the blue diode 82, in the top trough 22 is a spectral sensor 84 which is sensitive to the light emitted from the blue diode 82.

The transmissivity, for example, of 470 nm list is proportional to the authenticity of paper and can thus provide a signal of its validity.

It will thus be seen that the present invention provides mechanical security means for rejecting currency which is missized, mutilated and on which stringing or tail devices are applied. The invention also provides mechanical means for preventing the unlawful withdrawal of valid currency once such currency is detected. The present invention also provides an additional security device by which the authenticity of the paper itself is determined thus overcoming the problem of mistakenly accepting photo or graphically copied currency.

The specific mode of functioning of the various security devices in the currency validator is obtained through the use of a central control system comprising a CPU which may be a commonly available microchip such as the INTEL 8751 micro-controller. This chip contains a microprocessor, interface ports and on-board memory to the outputs of which are connected the various trigger circuits and controllers for operating the conveyor motor, storage unit, evaluation (i.e., validity and value) circuits as well as any peripheral units. To the CPU there is provided as input, the output of the various sensors and detectors for maintaining security as well as determining validity and value.

Reference, of course, can be made to the patents and prior devices referred to earlier, their disclosure having been included herein as if more fully set forth.

In operation, as the bill enters the passageway, its leading edge will trip the upstream inlet detector 21 inputting a signal to the CPU. The CPU correspondingly outputs a signal, via motor controller unit, causing the motor 46 to be operated in the forward direction. As a result, the belt and roller conveyor grasp the bill C and indexes the same forwardly until the entire bill is positioned for proper evaluation. Once proper evaluation is made, the CPU signals the motor to index the bill past the downstream gate 50 into the storage unit.

In the event the evaluation sensors (72, 84) do not determine that the bill is valid, and/or has a value that is intended to be detected, a signal output is issued to the motor control unit reversing the motor 42 causing the conveyor system to reverse and eject the bill from the inlet slot 20.

In any event, should the upstream "tail" sensor 66 detect the presence of a tail extending from the bill through the inlet, a signal is provided to the CPU halting all operation of the CPU except for the reversal of the motor 46 to cause ejection of the bill C. It may also be desired to simultaneously activate an alarm warning the police or the vending proprietor that an unlawful violation is being made.

It will then be seen that the present invention provides a simple, effective means for obtaining the objects and advantages earlier enumerated. An unexpected benefit is obtained from the present invention in that no only will valid currency be detected, but also any invalid bills which have been unlawfully inserted in the validator.

Various modifications and changes have been disclosed herein, and others will be apparent to those skilled in this art. Therefore, it is to be understood that the present disclosure is by way of illustrating and not limiting of the present invention.

What is claimed is:

1. In an apparatus for determining the authenticity of paper currency, said apparatus having a conveyor defining a passageway for guiding individual and successive sheets of paper currency in flat condition, said passageway having an inlet for receiving said currency and an outlet for discharging said currency to a storage device, and drive means connected to and selectively driving said conveyor in an upstream direction for moving said received paper currency through the passageway to the storage device or downstream through said inlet; security means comprising a light source located along one side edge of said conveyor at said inlet and a light sensor located along the other side edge of said conveyor in opposition to said light source, said light source and sensor operatively arranged in the plane of the currency and transversely to the direction of movement of said currency through said passageway to determine the existence of any foreign object at said inlet after said currency passes said inlet; and processing means responsive to the level of the light sensed by said sensor to selectively move said currency forward to said storage device when the level of light is at a first condition or move the currency back out of said inlet when not at said level.

2. The apparatus according to claim 1, wherein the inlet to said passageway has a limited height such that only one paper currency sheet at a time can pass through unhindered.

3. The apparatus according to claim 1, said drive means transporting said received paper currency through said currency passageway on said conveyor means in a stepwise manner for said sensor to provide its outputs to said processing means at each respective step, and said processing means comparing the respective measured values to corresponding stored values obtained from corresponding steps on known valid currency.

4. The apparatus according to claim 1, said security means further comprising a downstream gate mounted in the currency passageway approximate the outlet, blocking said currency from withdrawal once the currency has passed the outlet.

5. The apparatus of claim 1, said security means further comprising an upstream gate mounted in the passageway approximate the inlet responsive to said processing means to be in an open position, allowing passage of said currency, and responsive to said processing means after the currency has been determined to be valid to be in a closed position blocking passage of said currency, said upstream gate unable to close if an occlusion exists after said currency passes said inlet, said processing means responsive to said upstream gate so that said currency will be rejected if said upstream gate is unable to close.

* * * * *